United States Patent [19]

McLean et al.

[11] Patent Number: 5,031,310

[45] Date of Patent: Jul. 16, 1991

[54] METHOD OF MANUFACTURING ELECTRICAL RECEPTACLES

[75] Inventors: Kenneth W. McLean; Charles R. S. Walker, both of London, Canada

[73] Assignee: Northern Telecom Limited, Montreal, Canada

[21] Appl. No.: 250,678

[22] Filed: Sep. 29, 1988

[51] Int. Cl.[5] ..... H01R 23/02

[52] U.S. Cl. ..... 29/831; 439/676; 439/701

[58] Field of Search ..... 439/676, 638, 650, 701, 439/741; 29/827, 831, 835, 843, 844, 850

[56] References Cited

U.S. PATENT DOCUMENTS

| | | | |
|---|---|---|---|
| 4,407,559 | 10/1983 | Meyer | 439/676 X |
| 4,712,234 | 12/1987 | Below et al. | 439/676 X |
| 4,790,769 | 12/1988 | Kanada | 439/676 X |
| 4,865,564 | 9/1989 | Denkmann et al. | 439/676 X |

*Primary Examiner*—Z. R. Bilinsky

[57] ABSTRACT

A method for manufacturing electrical receptacles using automated processes. A continuous strip of lead frames is fed into an apparatus which attaches and forms contact wires to each individual lead frame. Each lead frame is then affixed to a pre-formed terminal block. A forming process is performed on the lead frame and contact wires to create a base for the jack receptacle. A jack body is then placed over the contact wires, combining the contact wires into a final position to form the electrical receptacle.

24 Claims, 13 Drawing Sheets

METHOD OF MANUFACTURING ELECTRICAL RECEPTACLES

FIELD OF THE INVENTION

The invention relates generally to a method for manufacturing electrical receptacles. More particularly, the invention relates to a method for manufacture of electrical receptacles for use in telecommunications.

BACKGROUND OF THE INVENTION

Telecommunication jacks are generally well known. By and large the telecommunication jacks of the past have been manufactured to standards required for analogue communications. This has allowed for communications paths which may withstand breaks in transmission of up to 100 milliseconds. However, since the world is changing from analogue to digital communications, a considerably higher quality jack is essential. In the digital world, a break in communications of 1 millisecond could produce an erroneous signal to, for example, a telephone switching system thereby producing undesired results. It is thus imperative to have a more reliable telecommunications connection.

The manufacture of telecommunication jacks, in the past, has also been labour intensive, and thus costly. The existing jacks have generally consisted of many parts and sub-assemblies requiring large amounts of manual labour. An automated method of manufacture, therefore, would be preferable to increase output and reduce costs.

Furthermore, the existing telecommunication jacks have been susceptible to corrosion by ingested contaminants from outside sources. The existing jacks have generally been manufactured with contact wires positioned at the bottom of a jack opening, with no protection to outside contaminants being provided.

The present invention is directed to providing solutions to the above-mentioned problems of existing telecommunication jacks. Firstly, the jack is designed such that it has a modular central core consisting of few parts, the jack assembly being performed by a continuous automated process. Secondly, the jack receptacle manufactured by the method of the present invention is designed to provide for the higher quality needs of digital communications. Finally, the jack receptacle thus manufactured has jack contact wires which are at the top of the jack opening, with the jack being enclosed by a plastic enclosure having a shutter to allow access to the jack opening; thus restricting the ingestion of contaminants.

SUMMARY OF THE INVENTION

The present invention is a method of automated manufacturing for electrical receptacles. The receptacles are manufactured in a continuous fashion from preformed lead frames which are interconnected by carrier strips. Each individual lead frame is fed into position where contact wires are crimped and welded to conductors of the lead frame. The individual lead frame is attached to the backside of a terminal block. A forming process is then performed in which the conductors of the lead frame are wrapped around the edges of the terminal block and fixed into place on the topside of the terminal block. The contact wires are also formed at this stage to create elastically deformable spring contacts. A retainer attached to the terminal block and used to hold the contact wires in an equidistantly spaced relationship is then separated from the terminal block. The contact wires are bent 90° at the terminal block such that the attached retainer forms a back panel for the receptacle. A receptacle body of an insulated material is then attached to the terminal block to form an electrical conductor receiving cavity. The conductors of the lead frame are then fixedly attached to the terminal block by screws to complete the assembly. A cover may then be added to the assembly to protect the internal contact wires if so desired.

Stated in other terms, the present invention is a method of automated manufacturing of an electrical receptacle, the method comprising the steps of: feeding a first lead frame into an assembly unit; forming first ends of a plurality of contact wires such that the contact wires will mate with first ends of conductors on the first lead frame; fastening the contact wires to the conductors; fixing the lead frame to a terminal block; forming second ends of the conductors such that they wrap around to a backside of the terminal block; securing the conductors on the backside of the terminal block; fixing the second ends of the contact wires to a retainer part on the terminal block; bending a first bend in second ends of the contact wires to form an acute angle; separating the retainer part of the terminal block from the terminal block; bending a second bend in second ends of the contact wires at a point intermediate the retainer and the terminal block such that the retainer is substantially perpendicular to the terminal block and is adjacent to the terminal block; attaching an insulated housing to the terminal block.

Stated in yet other terms, the present invention is an electrical receptacle, the receptacle comprising: a plurality of conductors insulated one from another; a plurality of contact wires insulated one from another and connected to first ends of the plurality of conductors in a one to one relationship; a terminal block to which the conductors are attached; second ends of the plurality of conductors wrapped around to a backside of the terminal block and secured to the backside of the terminal block; a retainer substantially perpendicular to the terminal block and adjacent to the terminal block; the plurality of contact wires formed to mate with a plurality of channels on the retainer, and folded over the retainer to thereby form a plurality of equidistantly spaced elastically deformable electrical contact wires for electrical connection to a mating connector; an insulated housing attached to the terminal block, the insulated housing having a plug receiving cavity, opposing parallel side walls, and a back plate opposite and parallel to the plug receiving end; the plug receiving cavity containing the plurality of equidistantly spaced elastically deformable electrical contact wires.

BRIEF DESCRIPTION OF THE DRAWINGS

The invention will be further understood from the following description with reference to the accompanying drawings, in which.

DETAILED DESCRIPTION OF THE INVENTION

Figure 1:
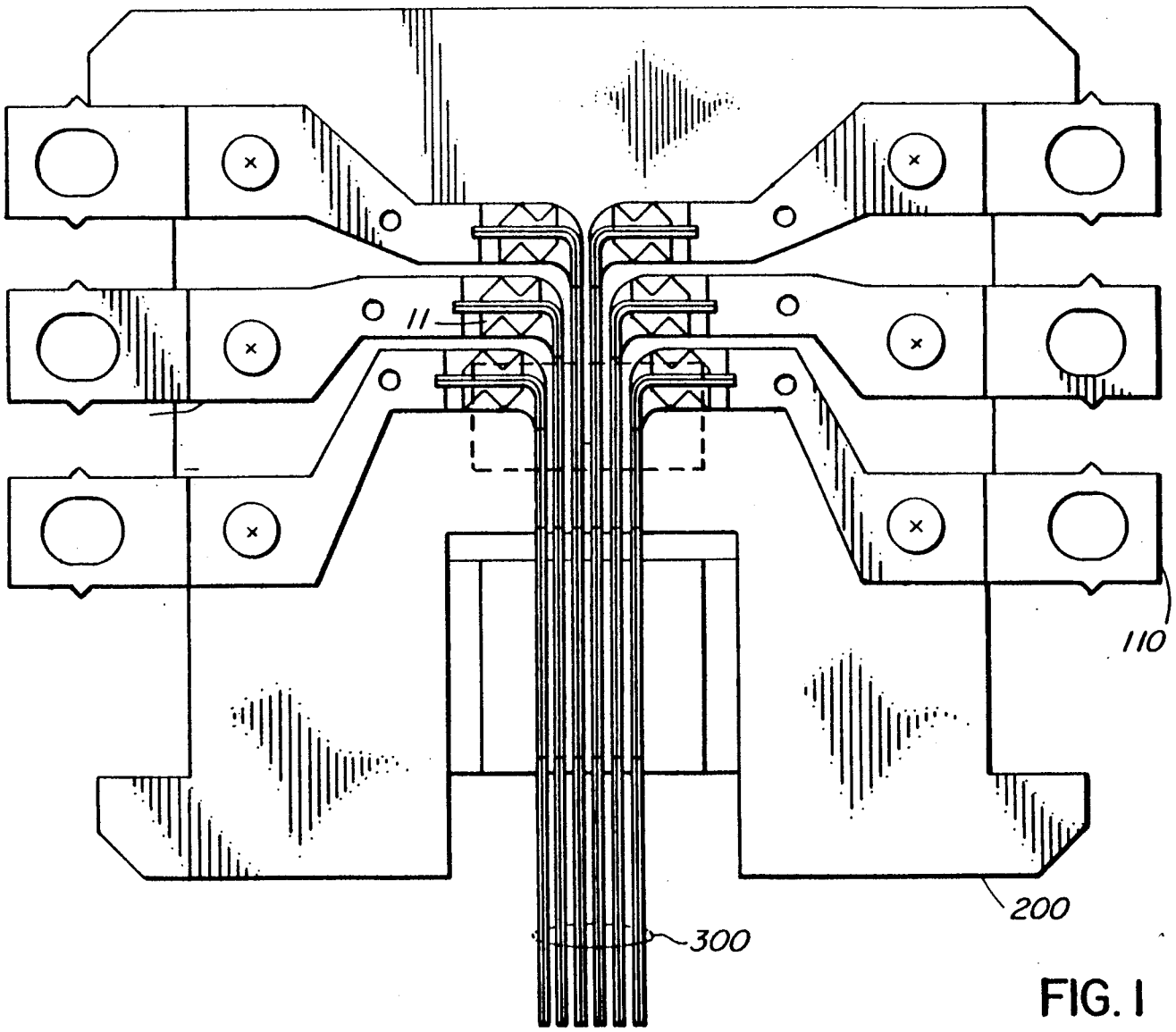
FIG. 1 is a bottom plan view of a terminal block.

FIG. 1 is a bottom view of an assembly of lead frame 110, contact wires 300, and terminal block 200 which together form part of jack receptacle 1000 of the present invention. The method of manufacture of jack receptacle 1000 is described in the following discussion.

Figure 2:
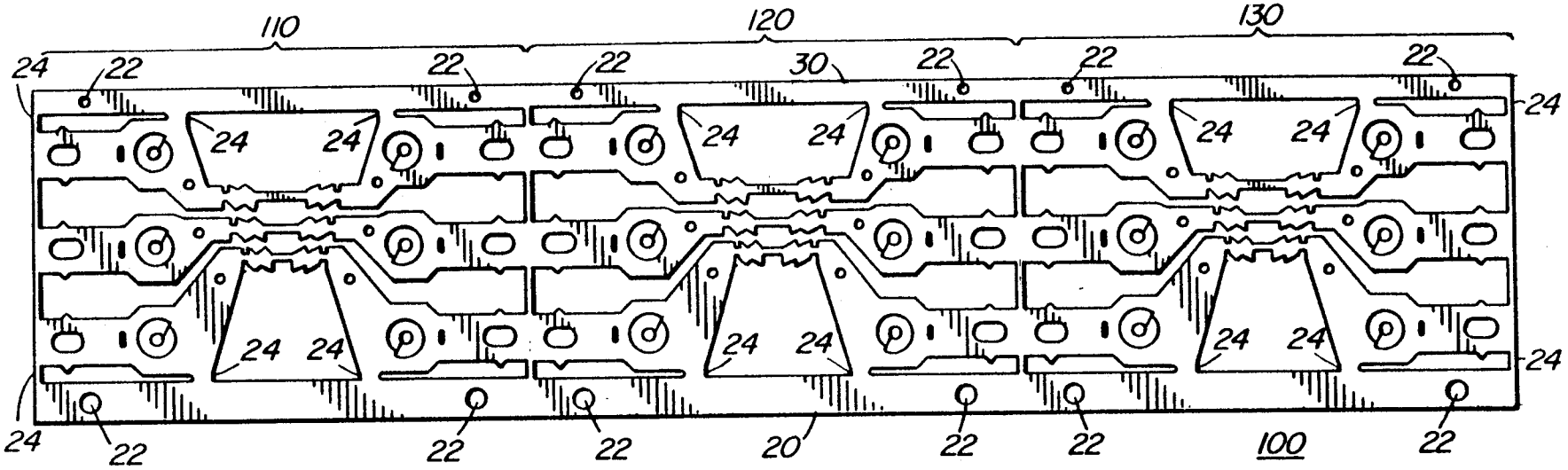
FIG. 2 is a top plan view of a lead frame strip.

FIG. 2 is a top plan view of a portion of lead frame strip 100 having lead frames 110, 120, and 130. Lead frame strip 100 is initially created by stamping a single strip of metal to form a plurality of lead frames, as well as carrier strips 20 and 30. Carrier strips 20 and 30, having positioning holes 22, are used to facilitate automated feeding of the lead frames into an assembly unit. Each lead frame 110, 120, and 130 is temporarily attached to carrier strips 20 and 30 by links 24. The lead frames are used to make electrical contact between a jack receptacle and external wiring (for example, the wiring from a telephone company).

Figure 3:
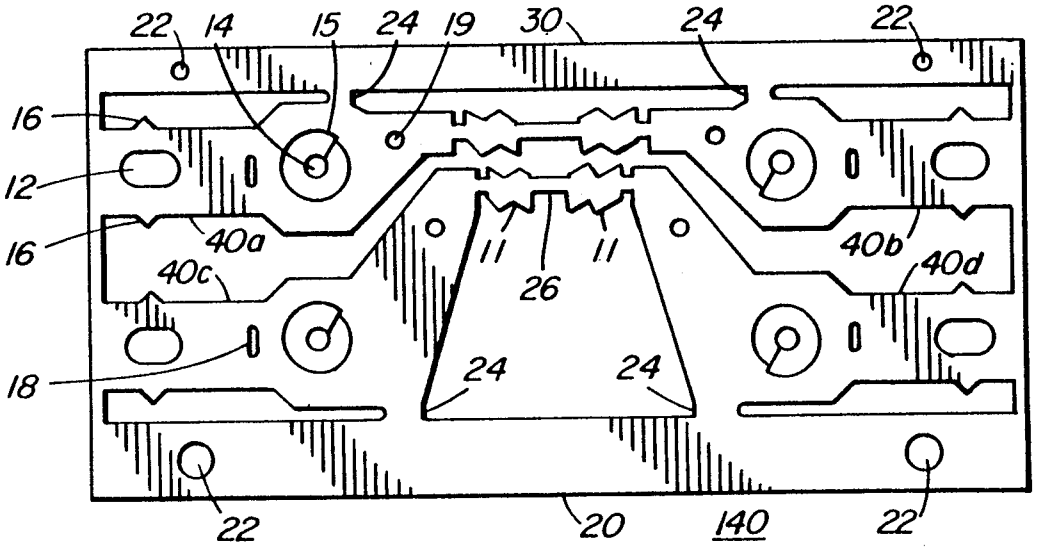
FIG. 3 is a top plan view of an individual four conductor lead frame.

FIG. 3, incorporating similar reference numbers as FIG. 2, shows a top plan view of an individual lead frame 140 attached to carrier strips 20 and 30. Lead frame 140 comprises four conductors 40*a*, 40*b*, 40*c*, and 40*d*. Each conductor 40 has within it an oblong clearance hole 12 and a thread hole 14 for accepting a screw after formation of lead frame 140. Clearance hole 12 is made oblong to account for variations in positioning caused by a step of the forming process. Adjacent clearance hole 12 are barbs 16 which are provided to aid in temporarily fixing conductor 40 to a terminal block. Thread form 15, surrounding thread hole 14, is provided to interact with a screw and a terminal block to thereby increase the amount of torque that may be applied to the screw. A relieve hole 18 is provided to facilitate bending of conductor 40 in a step of the forming process. Heat stake post hole 19 is provided to accept a heat stake post on a terminal block which is used to fasten lead frame 140 to the terminal block. Central to lead frame 140 each conductor 40 terminates in a crimp form 11 which is used to interconnect conductor 40 with a contact wire. Each crimp form 11 is temporarily attached to an adjacent crimp form 11 by a detachable link 26.

Figure 4:
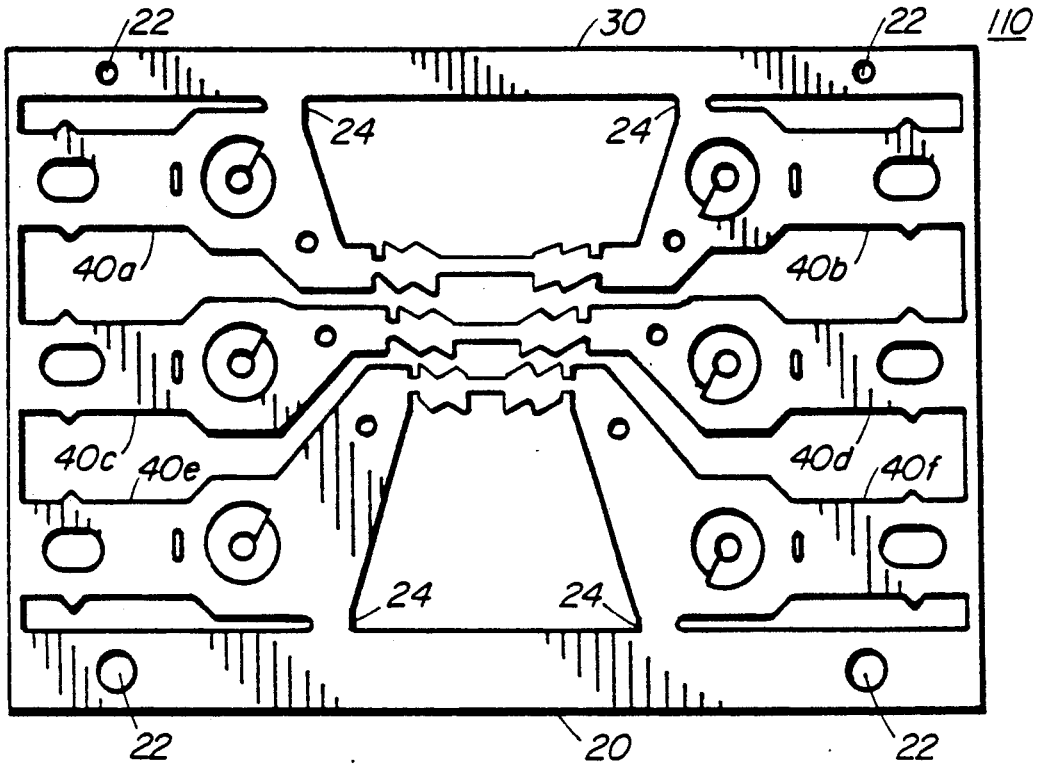
FIG. 4 is a top plan view of an individual six conductor lead frame.

FIG. 4 shows a top plan view of an individual lead frame 110. Lead frame 110 is similar to lead frame 140 of FIG. 3 except that lead frame 110 has six conductors (40*a*, 40*b*, 40*c*, 40*d*, 40*e*, 40*f*) as opposed to four. It can be realized that a lead frame can have any number of conductors incorporated in the design.

Figure 5:
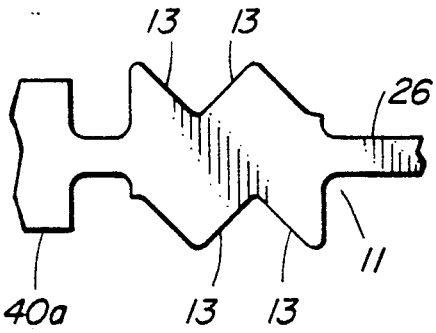
FIG. 5 is a top plan view of a crimp form.
Figure 6:
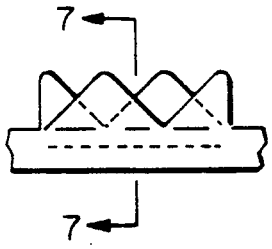
FIG. 6 is a side elevational view of a crimp form after it has been formed.
Figure 7:
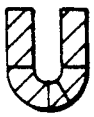
FIG. 7 is a cross-sectional view of the crimp form of FIG. 6 taken along the section lines 7—7.

FIG. 5 shows a top plan view of a crimp form 11 attached to a conductor 40*a* at one end. Affixed to the opposite end of crimp form 11 is a detachable link 26. Crimp form 11 is shaped such that a contact wire placed longitudinally central to crimp form 11 will be fastened by angular formations 13 when angular formations 13 are formed around the contact wire. FIGS. 6 and 7 illustrate the shape of crimp form 11 after an initial forming step. After a final forming step, crimp form 11 essentially takes on a cylindrical shape as viewed in cross-section.

Figure 8:
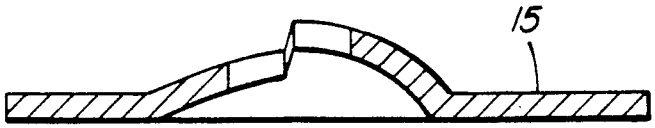
FIG. 8 is a cross-sectional view of a thread form.

FIG. 8 illustrates features of thread form 15. Thread form 15 comprises a spiral dome which acts as a tension device on a screw inserted into thread form 15. A screw inserted through a terminal block (to be described) will contact thread form 15. As the screw is screwed into thread form 15, the screw head will eventually contact the terminal block. At this point thread form 15 interacts with the screw and the terminal block to provide a resistance sufficient to allow the screw to be torqued down to the terminal block to a force of 8 inch pounds minimum.

Figure 9:
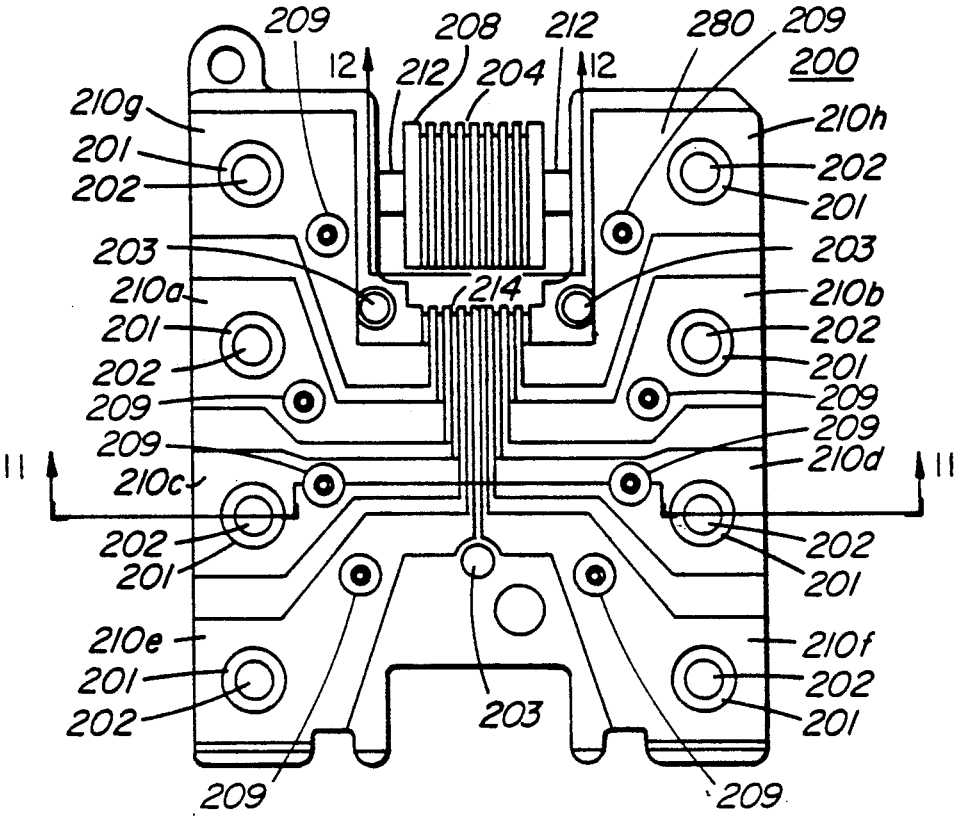
FIG. 9 is a bottom plan view of a terminal block.

FIG. 9 is a plan view of backside 280 of dielectric terminal block 200 showing contact forms 210 (a–h). Each contact form 210 is constructed to accept a conductor 40 from lead frame 110. Within each contact form 210 is a ridge 201 having a terminal hole 202 therein for accepting a screw. Ridge 201 interacts with thread form 15 of a conductor 40 to provide the screw resistance described above. Channels 214, on terminal block 200, are provided to accept contact wires (not shown in this Figure). FIG. 9 also illustrates how retainer 208, having channels 204 formed thereon (also provided to accept contact wires), is temporarily held in position by links 212. Post holes 203 are provided to accept posts of a jack body (to be described later). Also illustrated are heat stake posts 209 which are provided to interact with heat stake post holes 19 on lead frame 110 to fasten conductors 40 to terminal block 200.

Figure 10:
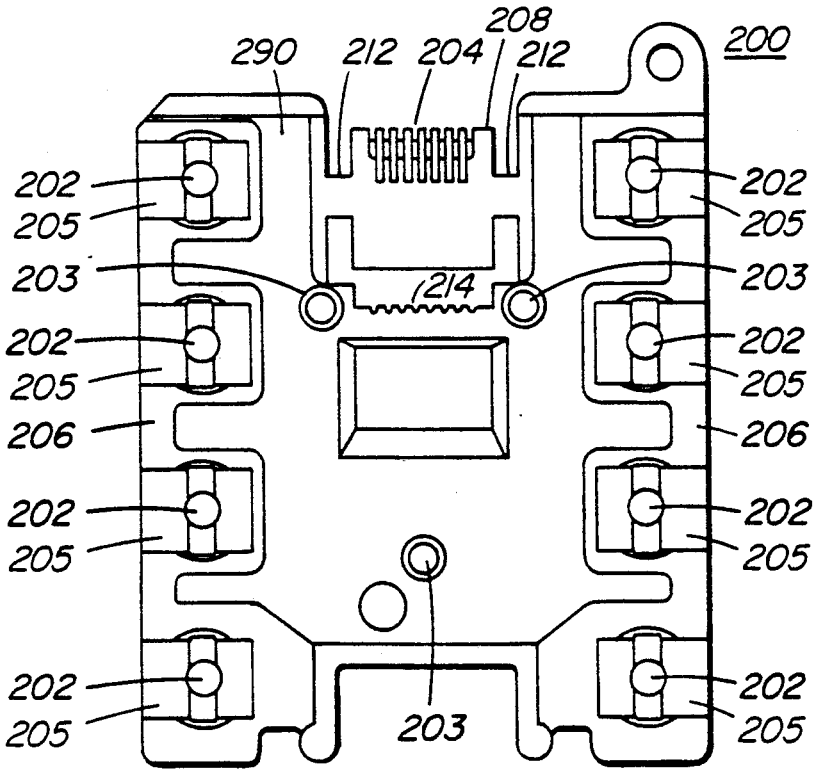
FIG. 10 is a top plan view of the terminal block of FIG. 8.

FIG. 10 is a top plan view of the topside 290 of terminal block 200. Each terminal hole 202 resides in a channel 205 which is separated from other channels 205 by an insulated ridge 206. Channels 205 are provided to accept the ends of conductors 40 after they have been formed around terminal block 200 (to be described later). Channels 205 cooperate with barbs 16 on conductors 40 to aid in temporarily fixing conductors 40 in-place until conductors 40 are fastened to terminal block 200 by screws.

Figure 11:
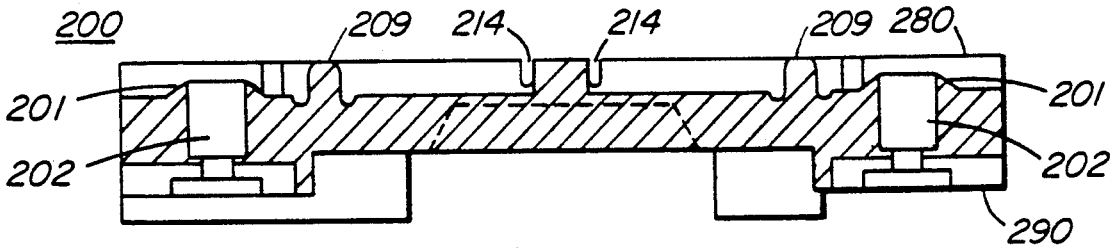
FIG. 11 is a cross-sectional view of the terminal block of FIG. 9 taken along section lines 11—11.

FIG. 11 illustrates terminal block 200 in cross-section through channels 205 and terminal holes 202. FIG. 11 further illustrates features of terminal block 200 as described above.

Figure 12:
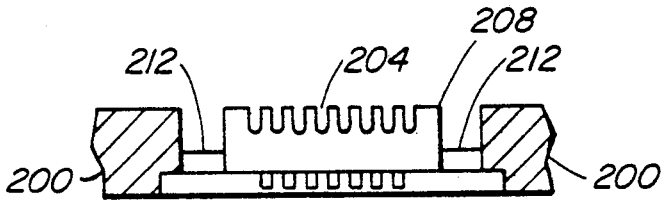
FIG. 12 is a cross-sectional view of the terminal block of FIG. 9 taken along section lines 12—12.

FIG. 12 is illustrative of the form of retainer 208 as seen in cross-section.

FIGS. 13*a* to 13*g* are provided as an overview of the steps of manufacture of the jack receptacle of the present invention. FIGS. 13*a* to 13*g* are illustrative of the manufacture of a six conductor jack receptacle. It can be realized that the process is the same for jack receptacles of other than six conductors. A detailed description of the steps of manufacture will follow the discussion of FIGS. 13*a* to 13*g*.

Figure 13A:
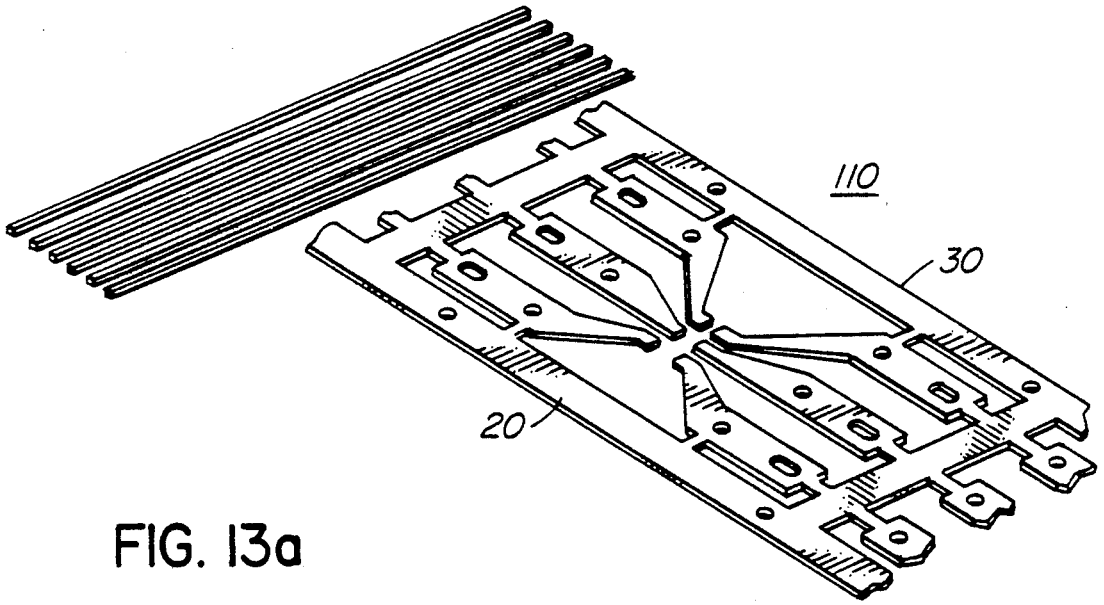
FIGS. 13*a*–13*g* are perspective views indicating the steps of manufacture of a jack receptacle.

FIG. 13*a* shows lead frame 110 in position with contact wires 300 ready for assembly.

Figure 13B:
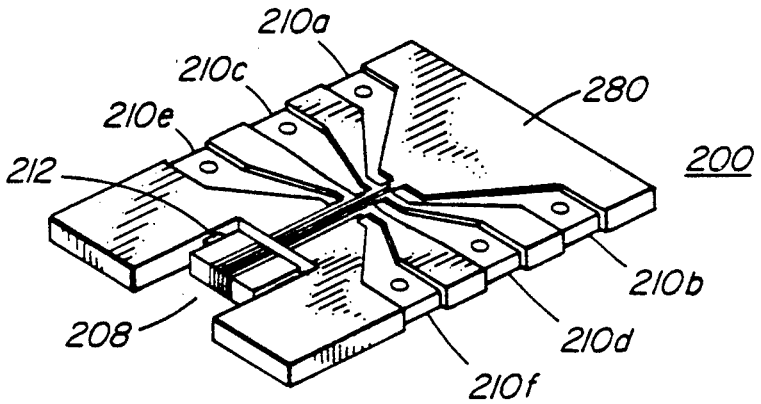

FIG. 13*b* illustrates terminal block 200 in position, ready to accept lead frame 110.

Figure 13C:
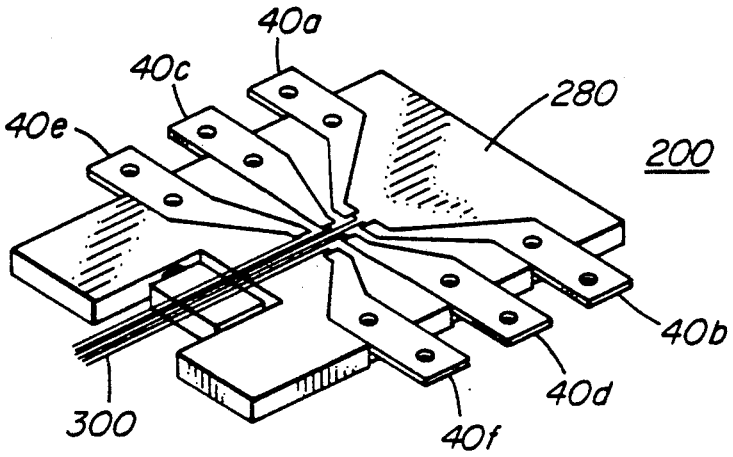
Figure 13D:
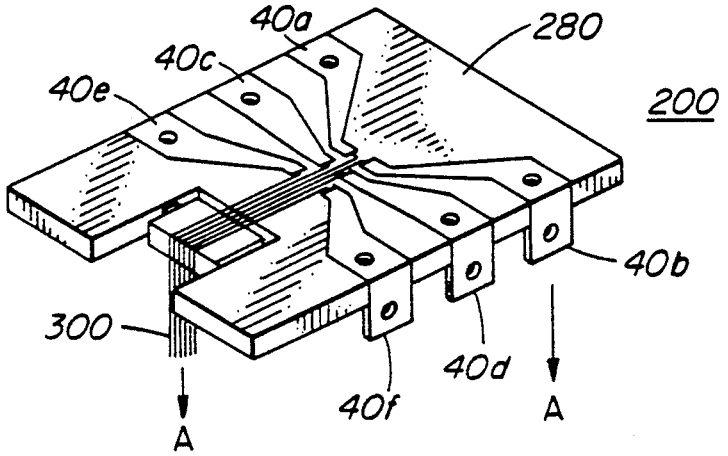

FIG. 13*c* shows the resulting product after contact wires 300 have been crimped to lead frame 110 and placed on the backside 280 of terminal block 200 (i.e. the items of FIGS. 13*a* and 13*b* have been mated to result in the item depicted in FIG. 13*c*). A forming process then takes place in which conductors 40 and contact wires 300 are bent (in direction A) perpendicular to the plane of backside 280 resulting in the formation illustrated in FIG. 13*d*.

Figure 13E:
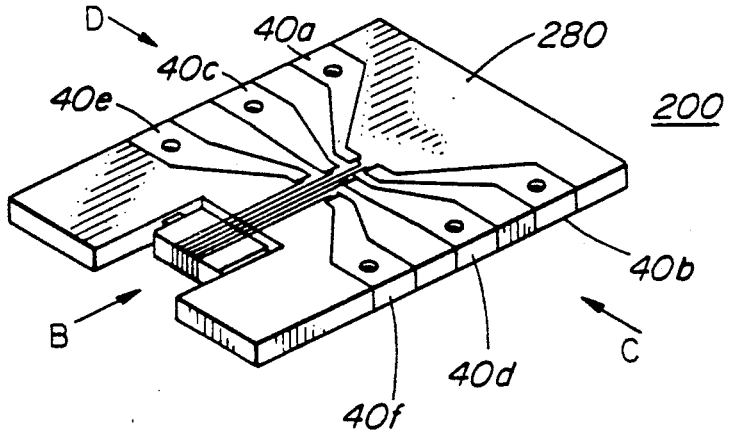

A further forming process, indicated in FIG. 13*e*, is then executed in which conductors 40 are bent (in directions C and D as appropriate) such that they contact terminal block topside 290. Contact wires 300 are also bent (in direction B) at this stage to form an angle to the plane of terminal block topside 290.

Figure 13F:
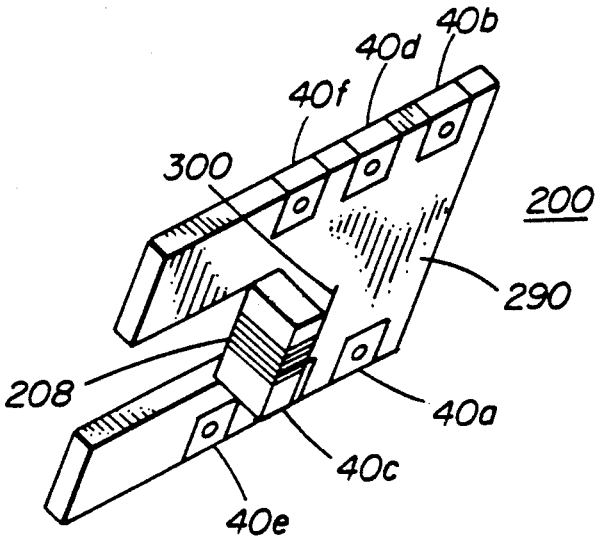

Retainer 208 is detached from terminal block 200 by cutting links 212. Contact wires 300 are bent intermediate retainer 208 and terminal block 200 such that retainer 208 is perpendicular to terminal block topside 290 and forms a back panel. The result is indicated in FIG. 13*f*.

Figure 13G:
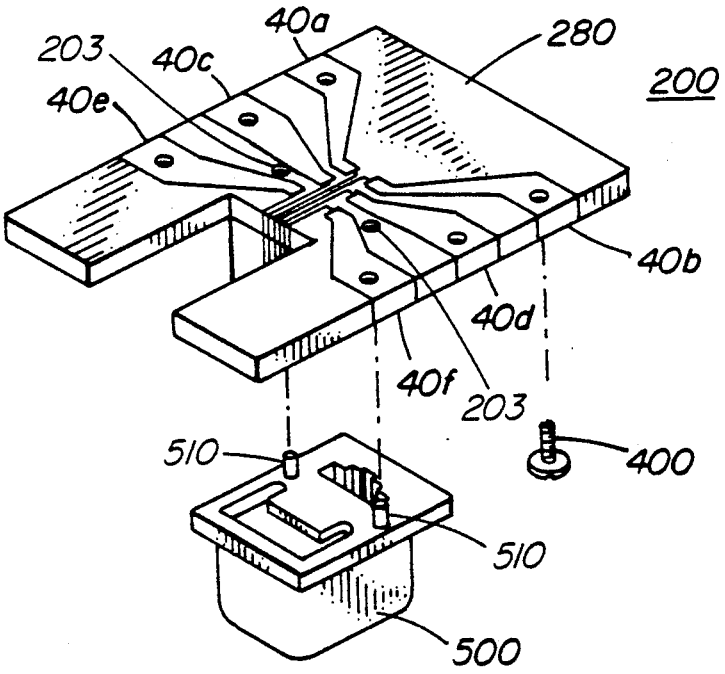

Finally, in FIG. 13*g*, an insulated receptacle body 500 is attached to terminal block 200 by posts 510 being inserted in post holes 203. Conductors 40 are secured in place by terminal screws 400.

The process will now be described in more detail, with reference to FIGS. 14 to 21. Each step of the process is performed on one jack receptacle assembly at a time.

Figure 14:
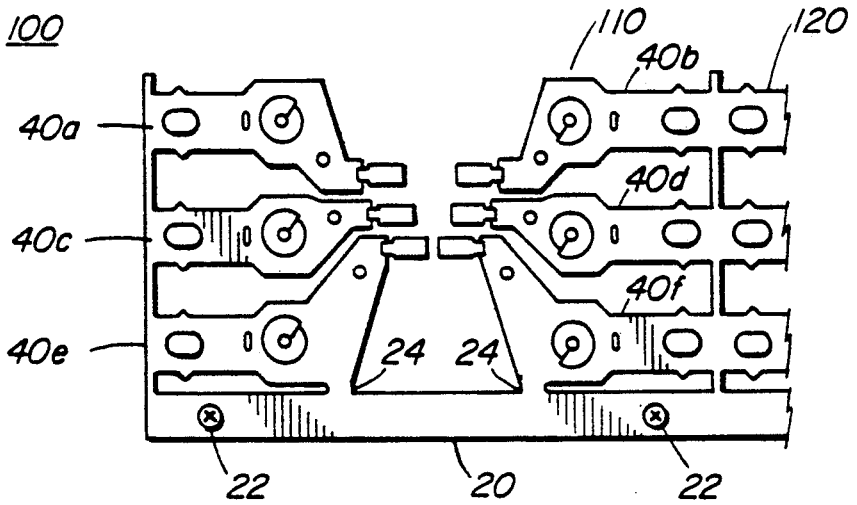
FIGS. 14–16 and 18–21 are detailed bottom plan views of the steps of manufacture of a jack receptacle.

To start the process lead frame strip 100 is fed into a machine (not shown) by carrier strips 20 and 30 and guide holes 22. Carrier strip 30 is removed by cutting links 24 from conductors 40. Crimps 11 are separated by removing links 26. The result is shown in FIG. 14.

Figure 15:
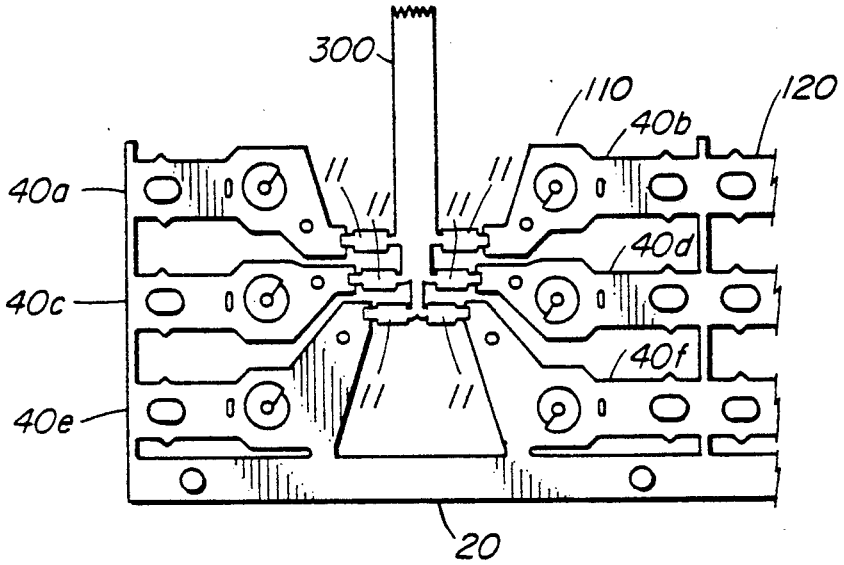

Contact wires 300 are then added and formed, two at a time, such that ends of contact wires 300 have a 90° bend, thereby allowing their placement over forms 11 while maintaining a spatial relationship between each individual contact wire 300. Contact wires 300 are held in place by crimping crimps 11 around contact wires 300, as shown in FIG. 15.

Figure 16:
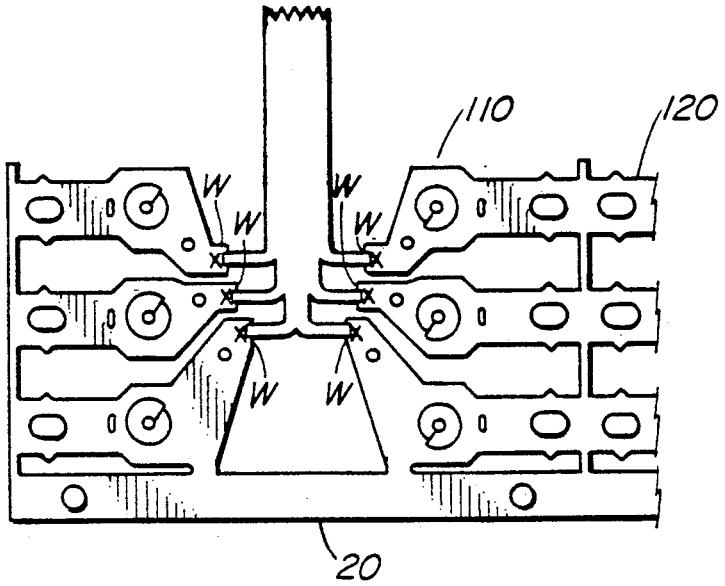

Contact wires 300 are further held in place by their ends being resistance welded to conductors 40 at points W, as indicated in FIG. 16. (In a preferred embodiment, the pull strength of the weld is a minimum of 6 pounds.) The welding process further provides better electrical contact between contact wires 300 and conductors 40.

Figure 18:
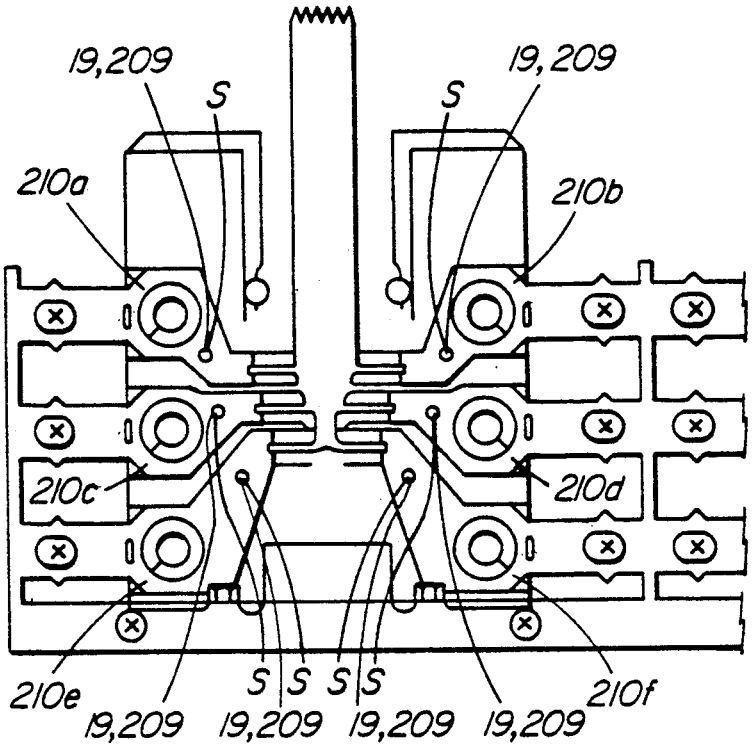

Lead frame 110 and contact wires 300 are then placed on terminal block 200 (which is fed into the assembly unit as an individual item) such that conductors 40 align with contact forms 210 and heat stake post holes 19 fit over heat stake posts 209, as shown in FIG. 18. Lead frame 110 is heat staked to terminal block 200 at points S (heat stake posts 209) to hold the assembly together. Contact wires 300, which now lie in channels 204 and 214 (not shown in FIG. 18), are fixed in position by heat staking channels 204 and 214.

Figure 17:
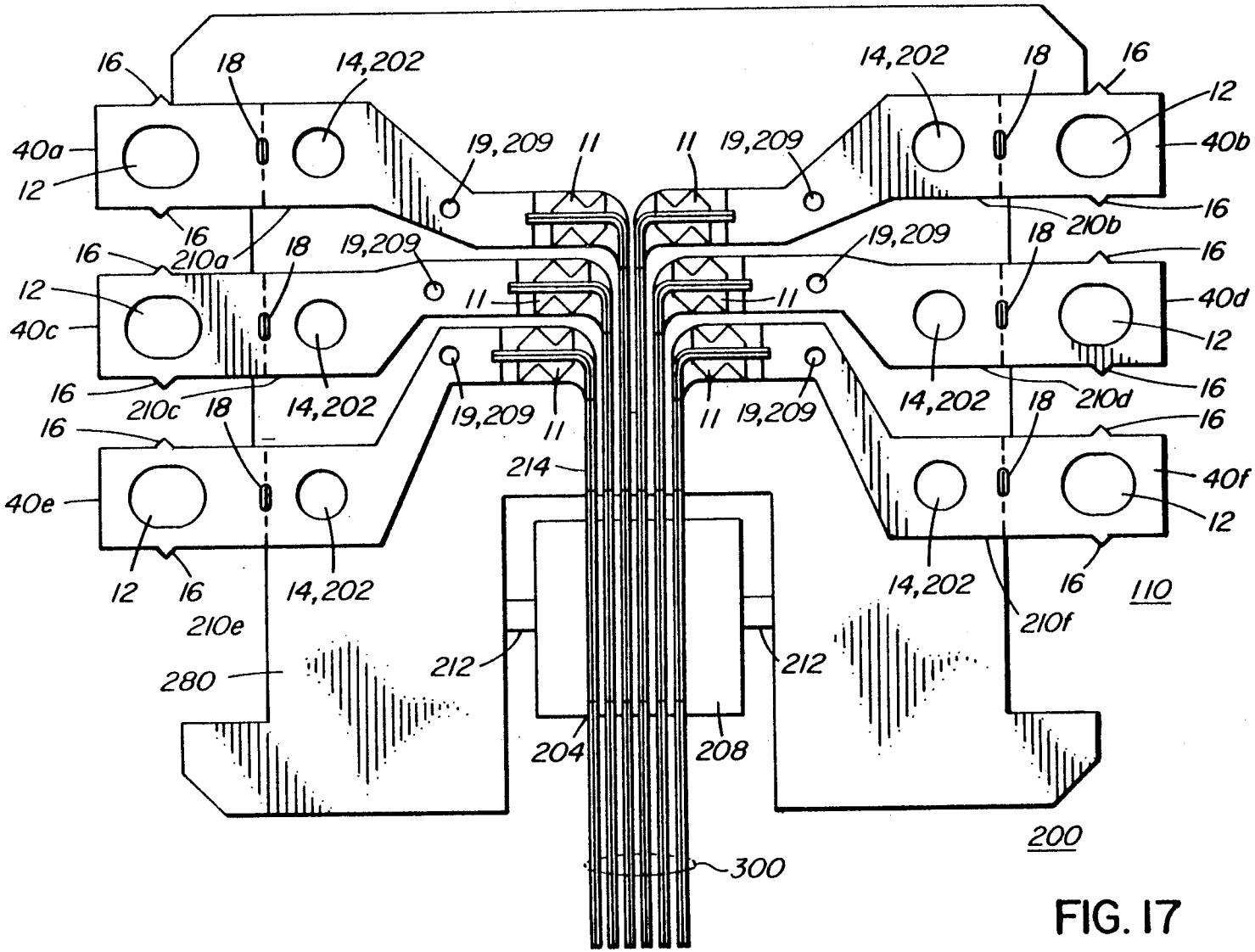
FIG. 17 is a bottom plan view of a terminal block after the final forming step.

FIG. 17 provides a clearer representation of the jack receptacle at this stage of the process. FIG. 17 is a bottom view of the assembly of lead frame 110, contact wires 300, and terminal block backside 280. FIG. 17 is illustrative of the one to one relationship of each conductor 40 with contact form 210. FIG. 17 is further illustrative of the positioning of contact wires 300 in channels 204 and 214.

Figure 19:
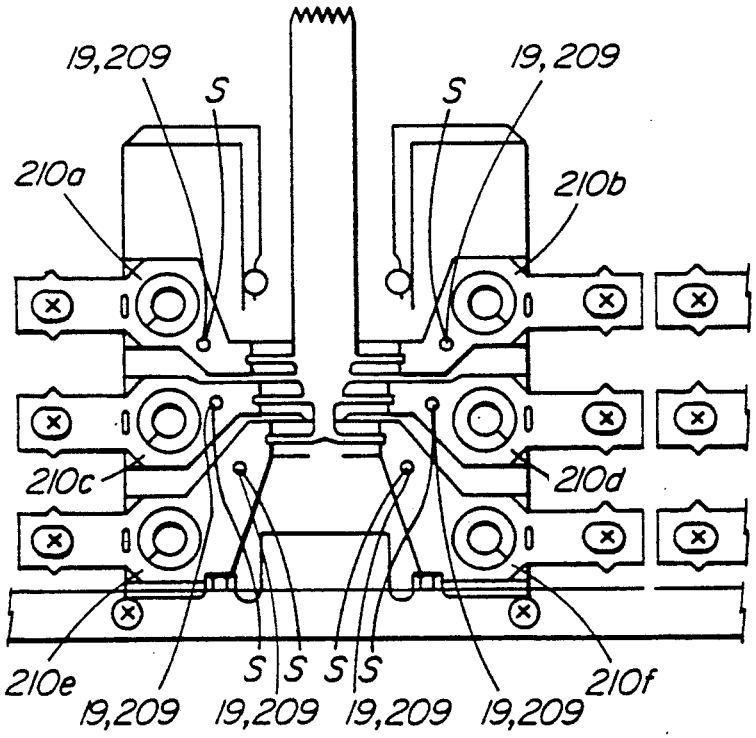
Figure 20:
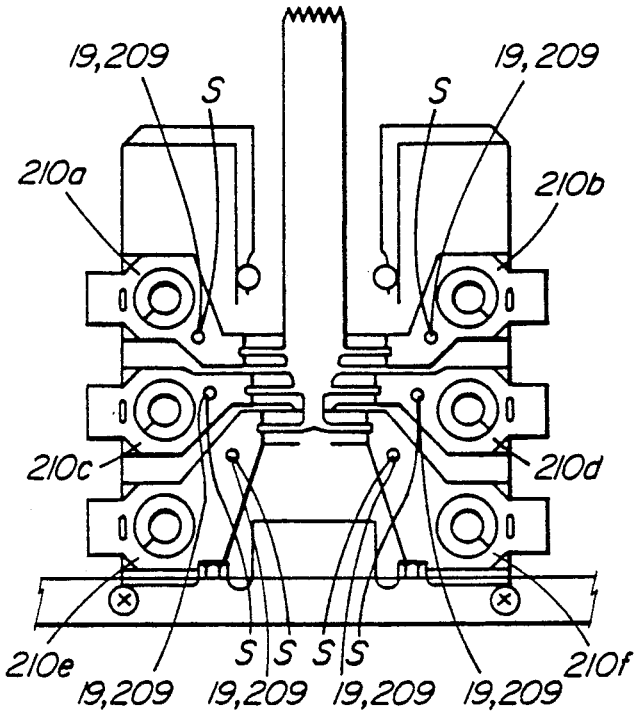
Figure 21:
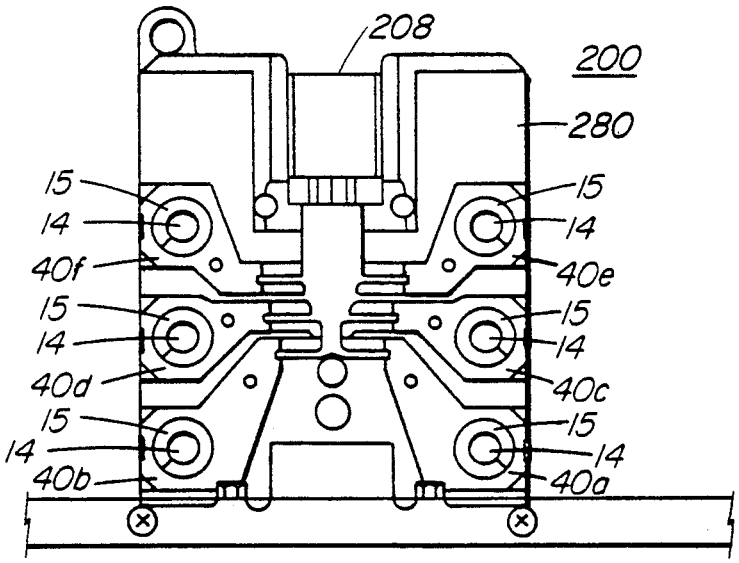

Links 24 are clipped from between lead frame sections 110 and 120, as shown in FIG. 19. Terminals 40 are then bent down towards topside 290 of terminal block 200 such that they are perpendicular to topside 290 and then bent again such that they are parallel to topside 290 and wrap around terminal block 200 (FIG. 20).

Figure 22:
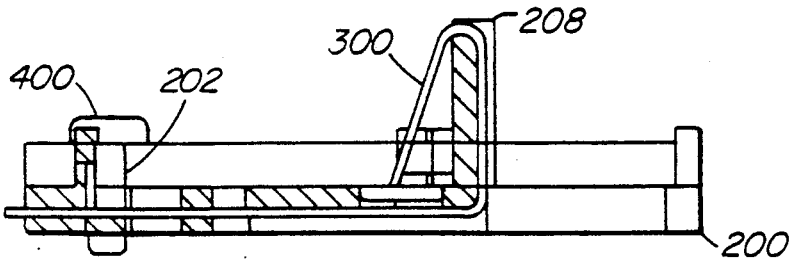
FIG. 22 is a cross-sectional view of the jack receptacle after a final forming step.
Figure 23:
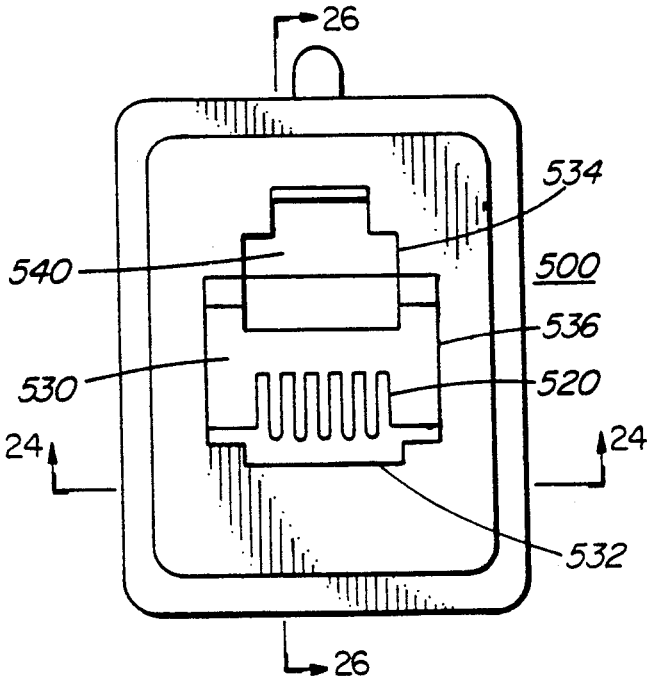
FIG. 23 is a top plan view of a jack body.
Figure 24:
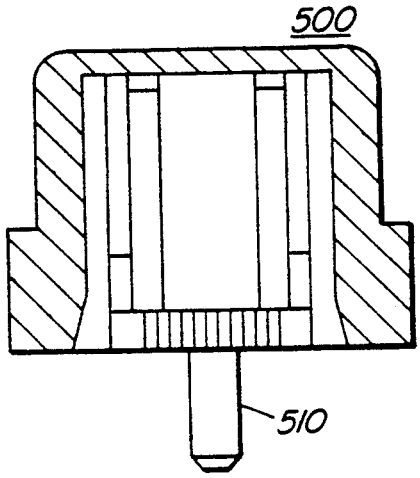
FIG. 24 is a cross-sectional view of the jack body of FIG. 23 taken through the section lines 24—24.
Figure 25:
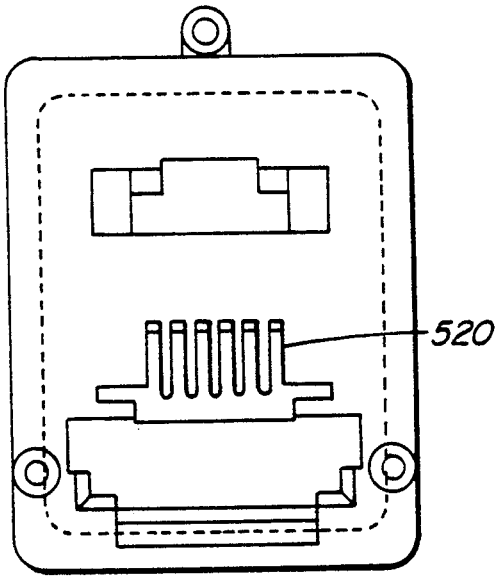
FIG. 25 is a bottom plan view of the jack body of FIG. 23.
Figure 26:
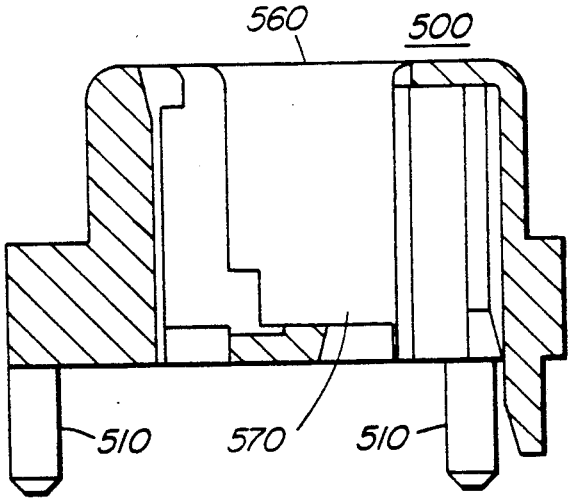
FIG. 26 is a cross-sectional view of the jack body of FIG. 23 taken through the section lines 26—26.

Lead frame 110 is then cut from carrier strip 20 by removing links 24. Contact wires 300 are bent approximately 90° to the plane of terminal block topside 290. Contact wires 300 are then further bent such that they form an angle with the plane of terminal block topside 290. Retainer 208 is cut from terminal block 200 by removing links 212. Contact wires 300 are bent 90° intermediate retainer 208 and terminal block 200 such that retainer 208 is placed perpendicular to the plane of terminal block topside 290. The resultant form of contact wires 300 is illustrated in FIG. 22. Self tapping terminal screws 400 are then inserted into clearance holes 12, through terminal holes 202, and finally through thread holes 14, interacting with thread forms 15 to secure conductors 40 and allow for interconnection of the jack receptacle to wires from the telephone company.

FIGS. 23–26 illustrate the features of insulated receptacle body 500. Body 500 comprises a dielectric housing having a plug receiving end 560, rearward end 570, and having a plug receiving cavity 530 which extends from plug receiving end 560 to rearward end 570. Plug receiving cavity 530 comprises lower and upper internal sidewalls 532, 534, and internal end walls 536. Plug receiving cavity 530 is contoured to receive a mating plug, which may have a latch which interacts with the contour of plug receiving cavity 530 to maintain a positive engagement of the mating plug with jack receptacle 1000. Within plug receiving cavity 530 is comb 520. The purpose of comb 520 is to maintain a spatial relationship between contact wires 300 as well as to maintain a maximum angle of contact wires 300 with respect to terminal block topside 290.

Figure 27:
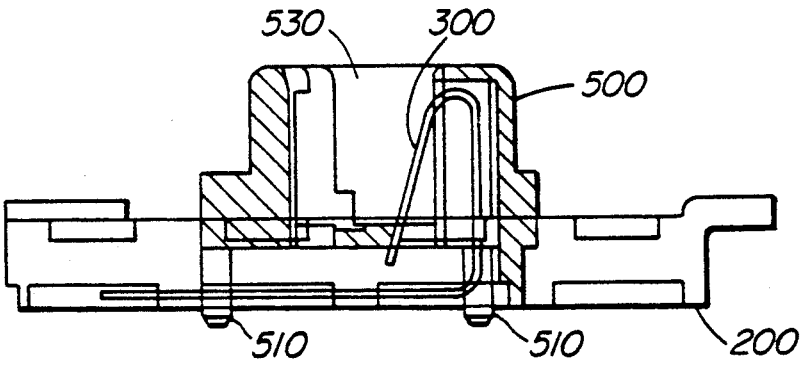
FIG. 27 is a cross-sectional view of the jack receptacle in its final form.

FIG. 27 is illustrative of the assembled jack receptacle as seen in cross-section. In this Figure can be seen the relationships between terminal block 200, insulated receptacle body 500 and contact wires 300.

Figure 28:
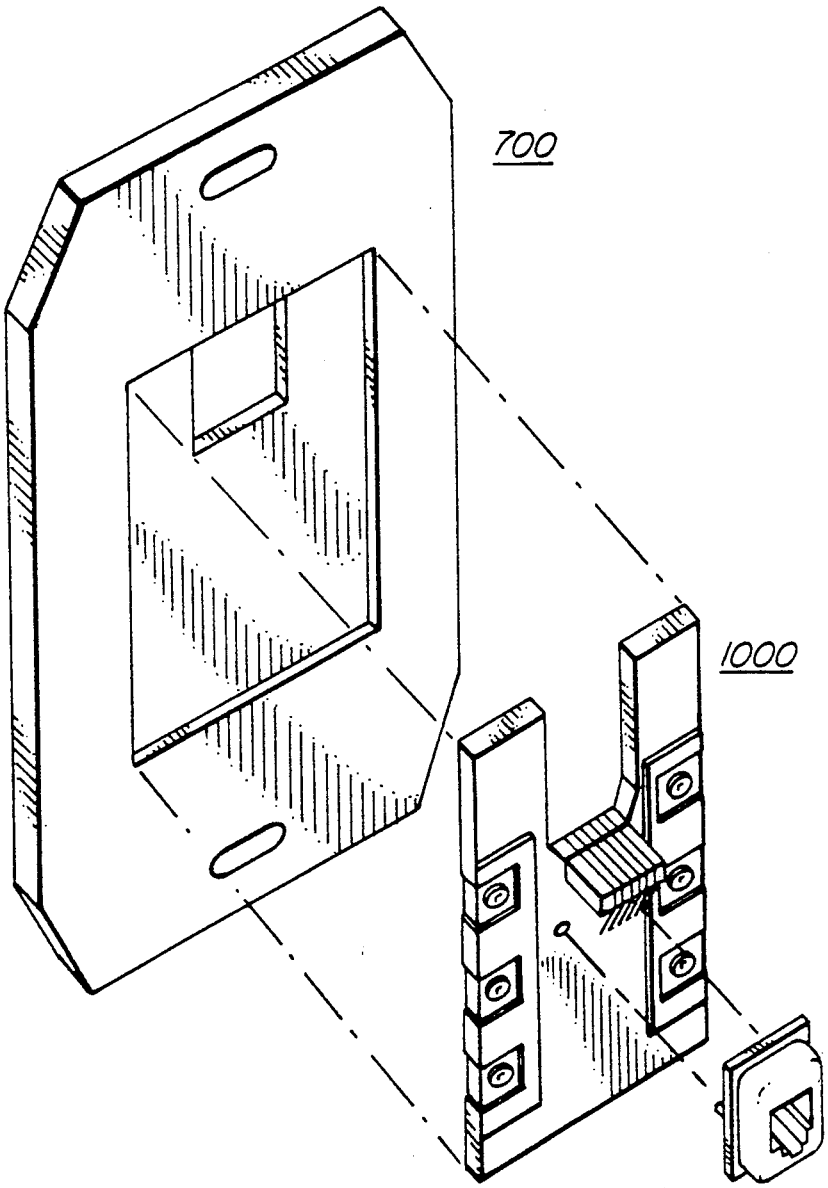
FIG. 28 is an exploded view of the jack receptacle.

FIG. 28 further illustrates the components of jack receptacle 1000 and how jack receptacle 1000 can be fitted into a suitable baseplate 700.

In a preferred jack receptacle: the contact wires are C654 wire; the lead frame is made of 260 brass, ½ hard, 0.41 millimeters thick; and the terminal block and jack body are made of flame retardant plastic.

Numerous other modifications, variations, and adaptations may be made to the particular embodiment of the invention described above without departing from the scope of the claims.

What is claimed is:

1. A method of automated manufacturing of an electrical receptacle, said method comprising the steps of:

a) feeding a first lead frame into an assembly unit;

b) forming first ends of a plurality of contact wires such that said contact wires can mate with first ends of conductors on said first lead frame;

c) fastening said contact wires to said conductors;

d) fixing said first lead frame to a terminal block;
e) forming second ends of said conductors such that they wrap around to a backside of said terminal block;
f) securing said conductors on said backside of said terminal block;
g) fixing said second ends of said contact wires to a retainer part on said terminal block;
h) bending a first bend in second ends of said contact wires to form an acute angle;
i) separating said retainer part of said terminal block from said terminal block;
j) bending a second bend in said second ends of said contact wires at a point intermediate said retainer and said terminal block such that said retainer is substantially perpendicular to said terminal block and is adjacent to said terminal block; and
k) attaching an insulated housing to said terminal block.

2. The method as claimed in claim 1 wherein said fastening step is performed by crimping said first ends of said conductors around said contact wires.

3. The method as claimed in claim 2 wherein said contact wires are further fastened to said conductors by welding.

4. The method as claimed in claim 1, 2, or 3 wherein said fixing step and said attaching step are performed by heat staking.

5. A method of automated manufacturing of an electrical receptacle, said method comprising the steps of:
a) feeding a first lead frame, of a plurality of lead frames on a lead frame strip, into position, said lead frame strip comprising two carrier strips disposed at opposite ends of said lead frame strip, wherein said carrier strips support said plurality of lead frames and facilitate positioning of said plurality of lead frames;
b) removing a first carrier strip of said two carrier strips;
c) forming first ends of a plurality of contact wires such that said contact wires can mate with first ends of conductors on said first lead frame;
d) placing said first ends of a plurality of contact wires in contact with said first ends of said conductors on said first lead frame;
e) crimping said first ends of said conductors to fasten said first ends of said contact wires to said conductors;
f) resistance welding said first ends of said contact wires to said first ends of said conductors;
g) fixing said lead frame to a terminal block by heat staking;
h) heat staking said contact wires to said terminal block;
i) separating said first lead frame from said plurality of lead frames;
j) forming second ends of said conductors such that they wrap around to a backside of said terminal block;
k) securing said conductors on said backside of said terminal block;
l) fixing second ends of said contact wires to a retainer part of said terminal block;
m) bending second ends of said contact wires to form an acute angle;
n) cutting said retainer from said terminal block;
o) bending said second ends of said contact wires at a point intermediate said retainer and said terminal block such that said retainer is substantially perpendicular to said terminal block and is adjacent to said terminal block;
p) attaching an insulated housing to said terminal block; and,
q) removing a second carrier strip of said two carrier strips.

6. An electrical receptacle, said receptacle comprising:
a plurality of conductors insulated one from another;
a plurality of contact wires insulated one from another and connected to first ends of said plurality of conductors in a one to one relationship;
a terminal block to which said conductors are attached;
second ends of said plurality of conductors wrapped around to a backside of said terminal block and secured to said backside of said terminal block;
a retainer substantially perpendicular to said terminal block and adjacent to said terminal block;
said plurality of contact wires formed to mate with a plurality of channels on said retainer, and folded over said retainer to thereby form a plurality of equidistantly spaced elastically deformable electrical contact wires for electrical connection to a mating connector;
an insulated housing attached to said terminal block, said insulated housing having a plug receiving cavity, opposing parallel side walls, and a back plate; said plug receiving cavity containing said plurality of equidistantly spaced elastically deformable electrical contacts.

7. The receptacle of claim 6 wherein each of said plurality of conductors has a thread form thereon, intermediate said first and second ends, for interaction with a corresponding ridge on a frontside of said terminal block whereby said thread form and said ridge interact to provide a resistance sufficient to allow a screw inserted through said thread form to be torqued to a minimum force of 8 inch pounds.

8. The receptacle of claim 6 wherein said terminal block has thereon a plurality of channels, each of said plurality of channels being separated by an insulated ridge, for accepting said plurality of conductors on said lead frame.

9. The receptacle of claim 7 wherein said terminal block has thereon a plurality of channels, each of said plurality of channels being separated by an insulated ridge, for accepting said plurality of conductors on said lead frame.

10. The receptacle of claim 8 or 9 wherein each of said second ends of said plurality of conductors have barbs attached thereto for interaction with one of said plurality of channels on said terminal block to maintain each of said second ends in position during manufacturing of said receptacle.

11. The receptacle of claim 6, 7 or 8 wherein said insulated housing is attached to said terminal block by posts on said insulated housing being inserted in post holes in said terminal block, said posts being heat staked to said terminal block after insertion.

12. The receptacle of claim 9 wherein said insulated housing is attached to said terminal block by posts on said insulated housing being inserted in post holes in said terminal block, said posts being heat staked to said terminal block after insertion.

13. The receptacle of claim 6, 7 or 8 wherein each of said plurality of contact wires are connected to each of said plurality of conductors, in a one to one relationship, by a crimp and a resistance weld.

14. The receptacle of claim 9 wherein each of said plurality of contact wires are connected to each of said plurality of conductors, in a one to one relationship, by a crimp and a resistance weld.

15. The receptacle of claim 6, 7 or 8 wherein each of said plurality of contact wires are heat staked to each of said plurality of channels on said retainer in a one to one relationship.

16. The receptacle of claim 6, 7 or 8 wherein each of said plurality of conductors are fixedly attached to said terminal block by screws.

17. The receptacle of claim 6, 7 or 8 wherein said plurality of conductors is 4.

18. The receptacle of claim 6, 7 or 8 wherein said plurality of conductors is 6.

19. The receptacle of claim 6, 7 or 8 wherein said plurality of conductors is 8.

20. The receptacle of claim 8 or 9 wherein said plurality of channels on said terminal block is 4.

21. The receptacle of claim 8 or 9 wherein said plurality of channels on said terminal block is 6.

22. The receptacle of claim 8 or 9 wherein said plurality of channels on said terminal block is 8.

23. The receptacle of claim 6, 7 or 8 wherein said plurality of contact wires are manufactured from C654 wire, said plurality of conductors are manufactured from 260 Brass, ½ hard, and said terminal block and said insulated housing are manufactured from flame retardant plastic.

24. The receptacle of claim 9 wherein said plurality of contact wires are manufactured from C654 wire, said plurality of conductors are manufactured from 260 Brass, ½ hard, and said terminal block and said insulated housing are manufactured from flame retardant plastic.

* * * * *